US006422260B2

(12) United States Patent
Danowski et al.

(10) Patent No.: US 6,422,260 B2
(45) Date of Patent: Jul. 23, 2002

(54) TRAP PRIMER

(75) Inventors: Daniel J. Danowski, Albion; David Lawson, North East, both of PA (US)

(73) Assignee: Zurn Industries, Inc., Erie, PA (US)

( * ) Notice: Subject to any disclaimer, the term of this patent is extended or adjusted under 35 U.S.C. 154(b) by 0 days.

(21) Appl. No.: 09/804,461

(22) Filed: Mar. 12, 2001

Related U.S. Application Data

(60) Provisional application No. 60/189,174, filed on Mar. 14, 2000.

(51) Int. Cl.[7] ..... E03C 1/296

(52) U.S. Cl. ..... 137/118.05; 137/247.25; 137/271

(58) Field of Search ..... 137/118.02, 118.05, 137/247.25, 271

(56) References Cited

U.S. PATENT DOCUMENTS

| | | | | | |
|---|---|---|---|---|---|
| 1,759,826 | A | | 5/1930 | Goss | |
| 1,967,643 | A | * | 7/1934 | Williams | 137/118.05 |
| 1,967,644 | A | * | 7/1934 | Williams | 137/118.05 X |
| 1,967,645 | A | * | 7/1934 | Williams | 137/118.05 |
| 1,970,744 | A | | 8/1934 | Goss | |
| 1,981,540 | A | * | 11/1934 | Bale | 1378/118.05 |
| 2,067,425 | A | | 1/1937 | Strode | |
| 2,076,600 | A | | 4/1937 | Smith | |
| 2,126,140 | A | | 8/1938 | Ross | |
| 2,154,659 | A | * | 4/1939 | Boydston | 137/118.05 |
| 2,154,811 | A | | 4/1939 | Goss | |
| 2,157,545 | A | * | 5/1939 | Klosterman | 137/118.05 |
| 2,162,236 | A | | 6/1939 | Williams | |
| 2,169,541 | A | * | 8/1939 | Smith | 137/118.05 |
| 2,496,465 | A | * | 2/1950 | Goss | 137/118.05 |
| 3,134,392 | A | * | 5/1964 | Goss | 137/118.05 |
| 3,422,835 | A | * | 1/1969 | Watts | 137/115.06 |
| 4,000,752 | A | | 1/1977 | Miller et al. | |

OTHER PUBLICATIONS

Zurn Catalogue, Product No. Z–1022, C.N. No. 71172, Mar. 21, 1995.
Zurn Catalogue, pp. 80 and 82. Date Unknown.
Wade Catalogue, p. 48. Date Unknown.
J.R. Smith Mfg. Co., pp. 46–47. Date Unknown.
Josam Catalogue, Part Nos. 1460–A, 1460–BB. Date Unknown.

* cited by examiner

*Primary Examiner*—John Rivell
(74) *Attorney, Agent, or Firm*—Webb Ziesenheim Logsdon Orkin & Hanson, P.C.

(57) ABSTRACT

A trap primer that includes a spring-loaded piston wherein the trap primer includes a body and the piston is slidably received therein and includes a plurality of circumferentially-spaced fingers.

21 Claims, 3 Drawing Sheets

TRAP PRIMER

CROSS REFERENCE TO RELATED APPLICATION

This application claims the benefit of U.S. Provisional Application Ser. No. 60/189,174, filed Mar. 14, 2000.

BACKGROUND OF THE INVENTION

1. Field of the Invention

The present invention relates to trap primers for supplying a small amount of water periodically to a drain trap.

2. Description of the Prior Art

When a drain is infrequently used, the water in its trap evaporates allowing sewer gas to enter the building. It is, therefore, necessary to provide an automatic device for supplying water periodically to the drain trap to keep it filled. Various types of prior art primer valves have been developed and used for that purpose.

In many instances the operation of drain trap primers may affect the flow of water through the waterline and not yield instantaneous flow to the water controlling device such as faucets. In other instances the drain trap primer may not properly control water to the trap and supply an excess amount of water thereto, and waste water.

Therefore, it is an object of the present invention to provide a drain trap primer to overcome these deficiencies.

SUMMARY OF THE INVENTION

The present invention is a trap primer that includes a body defining an inlet port, an outlet port and a trap primer port in fluid communication with a shut off cavity. A piston assembly is received within the shut off cavity. The piston assembly includes a piston movable in a longitudinal direction within the sealing cavity and a seat defining a passageway with the trap primer port. The seat is in fluid communication with the trap primer port. The piston is biased in a first position to block the passageway when liquid is not flowing through the body. The piston is adapted to move to a second position when fluid is flowing from the inlet port to the outlet port through the body, permitting fluid to flow through the passageway defined in the seat.

More specifically, the present invention is a trap primer that includes a body, a piston, and a seat. The body defines an inlet port, an outlet port, and a trap primer port in fluid communication with a shut off cavity. The piston assembly is received within the shut off cavity, the piston assembly includes a piston movable in a longitudinal direction within the shut off cavity. The seat defines a passageway in fluid communication with the trap primer port. The piston is biased in a first position to block the passageway of the seat when liquid is not flowing through the body. The piston is adapted to move to a second position when fluid is flowing from the inlet port to the outlet port through the body, permitting fluid to flow through the passageway of the seat.

The piston includes a piston sealing surface and a seat includes a seat sealing surface, wherein when the piston is in the first position, the seat sealing surface contacts the seat sealing surface and blocks the passageway, and when the piston is in the second position, the piston sealing surface is spaced a distance away from the seat sealing surface. Preferably, one of the seat sealing surfaces and the piston sealing surfaces is curved relative to the other of the seat sealing surface and the piston sealing surface. More preferably, the seat sealing surface is curved relative to the piston sealing surface.

The seat body is secured to the body of the trap primer. Preferably, the seat body is threadably secured to the body. The seat body can be generally cylindrical in shape and is solid with the exception of a passageway defined therein. Alternatively, the seat body is cylindrical shaped defining a hollow cavity, an inlet hole, and an outlet hole. The inlet hole, hollow cavity, and the outlet hole are in fluid communication with each other, and the inlet hole is in direct fluid communication with the shut off cavity and the outlet hole is in direct fluid communication with the trap primer port. The passageway is defined by the inlet hole, the hollow cavity, and the outlet hole. The inlet hole has an inlet hole diameter, the outlet hole has an outlet hole diameter, and the hollow cavity has a hollow cavity diameter, wherein the hollow cavity diameter is greater than the inlet hole diameter and outlet hole diameter. Preferably, the seat sealing surface defines the inlet hole and the seat sealing surface is frusta-spherical in shape.

The piston includes a piston body having a cylindrical portion with a tip extending therefrom. The tip defines the piston sealing surface. The tip includes a gasket seal that includes the piston sealing surface. Preferably, the gasket seal is made of rubber. Further, the piston includes a piston body having an outer surface, wherein the outer surface has a plurality of circumferentially-spaced fingers extending along the longitudinal direction. The fingers define finger passageways therebetween that extend in the longitudinal direction. The piston body also includes a open top portion that defines an internal cavity having an upper edge offset from upper portions of the finger, wherein spaces are defined between the fingers that are in fluid communication with the internal cavity and the finger passageways.

A biasing member, such as a spring, is received within the internal cavity and sandwiched between the body and the piston.

The present invention is also a method for changing a trap primer seat that includes providing a trap primer as described hereinabove removing a first trap primer seat, and replacing the first trap primer seat with a second trap primer seat. The method further includes providing that the second trap primer seat has at least one diameter of the inlet hole and the outlet hole being different than respective the diameters of the inlet hole and the outlet hole of the first trap primer seat.

DESCRIPTION OF THE PREFERRED EMBODIMENTS

Figure 1:
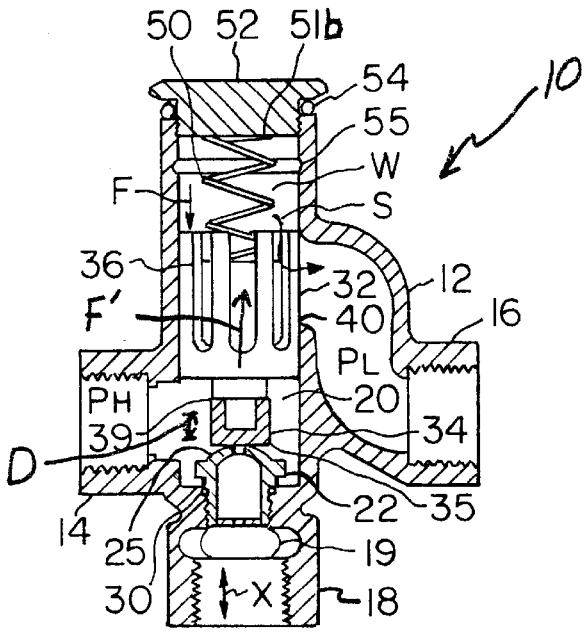
FIG. 1 is an elevational view, partially in section, of a trap primer made in accordance with the present invention.
Figure 2:
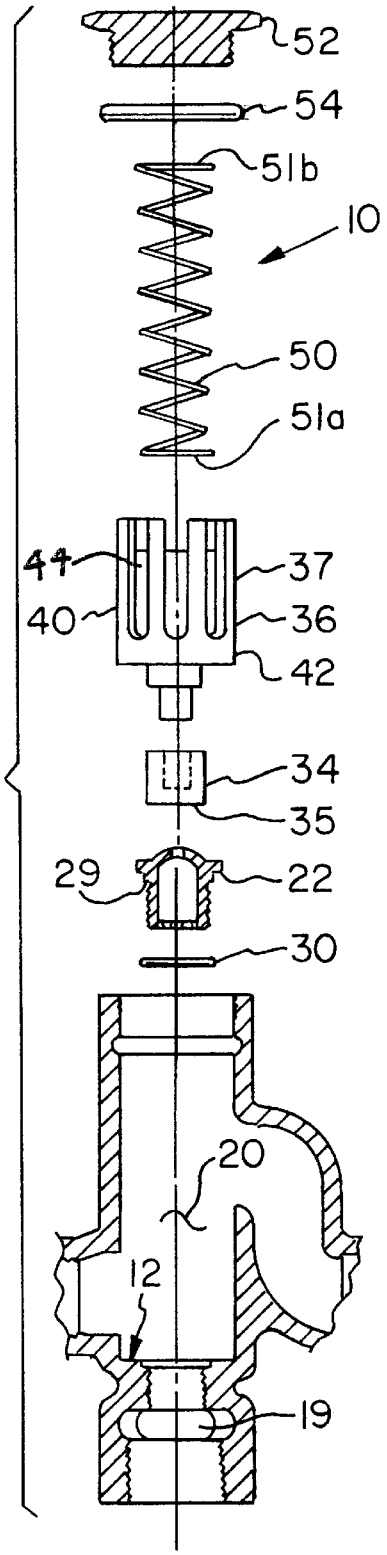
FIG. 2 is an elevational-exploded view of a portion of the trap primer shown in FIG. 1.
Figure 4:
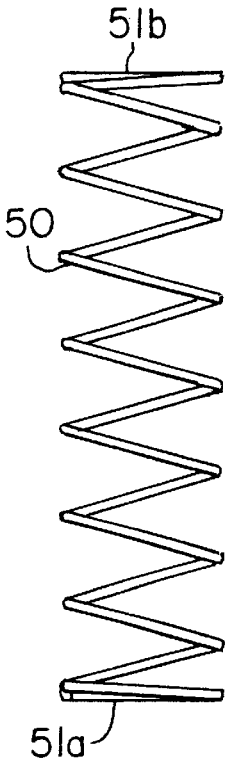
FIG. 4 is an elevational view of a spring used in the trap primer.

FIGS. 1 and 2 show a trap primer 10 made in accordance with the present invention. The trap primer 10 includes a body 12, preferably made of metal, such as bronze, having an inlet port 14, an outlet port 16 and a trap primer port 18 in fluid communication with the inlet port 14 and the outlet port 16. Vacuum ports or passageways 19 are defined in the trap port 18. The inlet port 14 is also in fluid communication with the outlet port 16. The body 12 also defines a shut off cavity 20 that is in fluid communication with the inlet port 14, outlet port 16, and trap primer port 18. A trap primer seat 22 is threadably received in the body 12 adjacent the trap primer port 18. The seat 22 has a passageway that is in fluid communication with the trap primer port 18 and the shut off cavity 20.

Figure 5A:
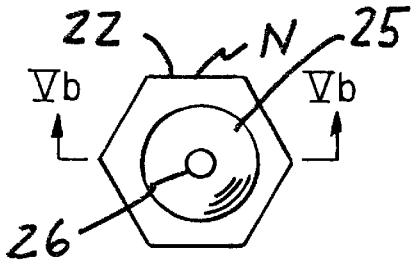
FIG. 5*a* is a plan view of a seat used in the trap primer shown in FIG. 1.
Figure 5B:
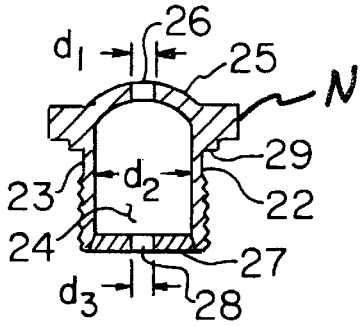
FIG. 5*b* is a section taken along lines Vb—Vb in FIG. 5*a;*
Figure 5C:
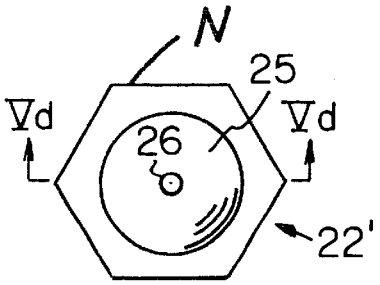
FIG. 5*c* is a plan view of a seat similar to that shown in FIG. 5*a;*
Figure 5D:
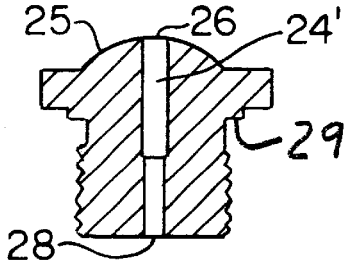
FIG. 5*d* is a section taken along lines Vc—Vc in FIG. 5*c;*

Referring to FIGS. 5*a* and 5*b*, the seat 22 includes a cylindrical-shaped body 23 that defines substantially a hollow cavity 24 which is in fluid communication with an inlet hole 26 and an outlet hole 28 defined in the body 23. The inlet hole 26 is in direct fluid communication with the shut off cavity 20 and the outlet hole 28 is in direct fluid communication with the trap primer port 18. The inlet hole 26 has an inlet diameter $d_1$, the outlet hole 28 has an outlet diameter $d_3$, and the hollow cavity 24 has a diameter $d_2$, where $d_2>d_1$ and $d_2>d_3$. The diameters $d_1$ and $d_3$ may be equal to each other or different. A frusta-spherical shaped surface or seat sealing surface 25 defines an upper portion of the body 23. The body 23 contains the cavity 24. The seat sealing surface 25 defines the inlet hole 26. An integral hexagonal nut N extends from the body 23 adjacent the upper portion of the body 23. The nut is adapted to be received by a wrench socket. A circular disc 27 defines a lower portion of the body 23 and defines the outlet hole 28. The inlet hole 26, outlet hole 28, and cavity 24 define a passageway of the seat 22. FIGS. 5*c* and 5*d* show a unitary seat 22' that is similar to seat 22, including all external dimensions, except it is one piece and includes an inlet hole 26 and an outlet hole 28. The seats 22 and 22' may be made of metal or polymeric material, such as plastic. The unitary seat 22' does not contain the cavity 24 but includes a passageway 24'. The unitary seat 22 includes a solid cylindrical-shaped body, with the exception of the passageway 24 defined therein. The unitary seats 22 and 22' have external threads and are threadably secured to the body 12. An O-ring 30, shown in FIGS. 1 and 2, is provided and sandwiched between a lip 29 of the seats 22 and 22' (shown in FIG. 5*b*) and a portion of the body 12 forming a fluid seal.

Figure 3A:
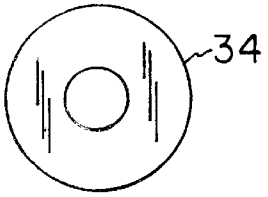
FIG. 3*a* is a plan view of a gasket seal.
Figure 3B:
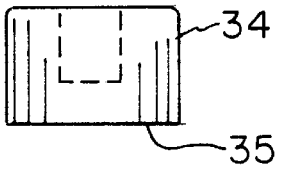
FIG. 3*b* is an elevational view of the gasket seal shown in FIG. 3*a;*

Referring back to FIG. 1, a piston assembly or a sealing assembly 32, which is adapted to move in a longitudinal axis X, is provided and received within the shut off cavity 20. The sealing assembly 32 includes a rubber gasket seal 34 having a flat piston sealing surface 35 (shown in FIGS. 3*a* and 3*b*) which is attached to a piston 36. The gasket seal 34 is a cylindrical closed bottom sleeve that comprises rubber EPDM 70 durometer. As can be seen, one of the seat sealing surfaces 25 and the piston sealing surfaces 35 is curved relative to the other. In the present case, the seat sealing surface 25 and the piston sealing surface 35 are flat, but the opposite can occur.

Figure 6A:
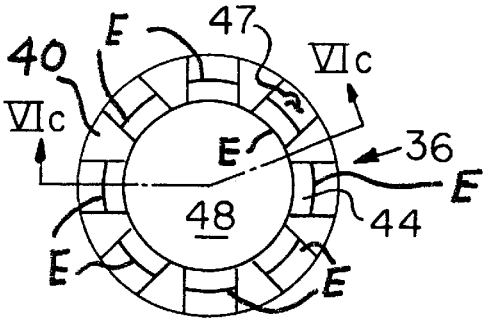
FIG. 6*a* is a plan view of a piston made in accordance with the present invention.
Figure 6B:
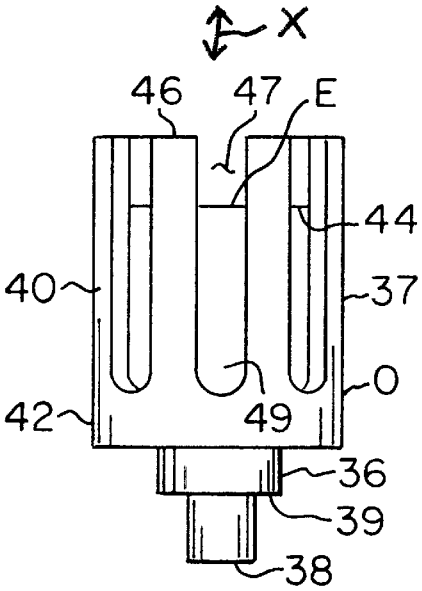
FIG. 6*b* is an elevational view of the piston shown in FIG. 6*a;*
Figure 6C:
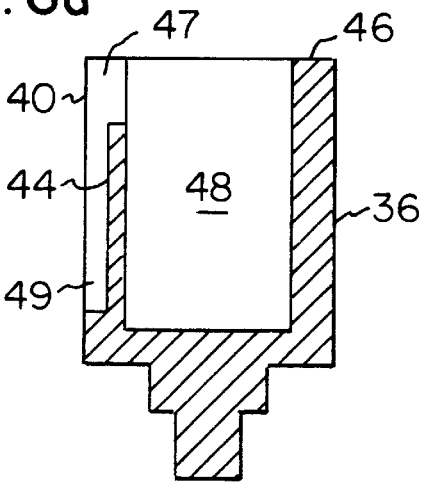
FIG. 6*c* is a section taken along lines VIc—VIc in FIG. 6*a;*

Referring to FIGS. 6*a*, 6*b* and 6*c*, the piston 36 includes a body 37 that is substantially cylindrical in shape and includes a tip 38 that depends from the body 37. Preferably, the piston is made of a polymeric material, such as plastic, although it can be made of metal or other material. The tip 38 receives the gasket seal 34. The gasket seal 34 abuts against a shoulder 39. The piston 36 is slidably received within the shut off cavity 20. The piston 36 has an outer surface O, which further includes a plurality of circumferentially-spaced fingers 40 that extend along the longitudinal direction X from a base 42. The tip 38 extends from an opposite side of the base 42. A cylindrical open top portion 44 is defined on the piston 36 and positioned radially inwardly or offset from the plurality of circumferentially-spaced fingers 40. An edge E of the cylindrical open top portion 44 does not extend to upper portions 46 of the fingers 40 so that spaces 47 are defined between the fingers 40 that are in fluid communication with an internal cavity 48 formed by the cylindrical open top portion 44. Passageways 49, extend along the longitudinal direction X, are defined between adjacent fingers 40, and are in fluid communication with respective spaces 47.

Referring to FIGS. 1, 2, 4, 6*a*, 6*b* and 6*c*, a compression spring 50 is received within the cavity 48 of the cylinder 44 and sandwiched between its ends 51*a* and 51*b* between the base of the cylinder 44 and a cover 52 threadably attached to the body 12, wherein the cover 52 forms a portion of the body 12. Preferably, the spring is made of stainless steel and has a spring constant of 0.550 pounds/inch, although it could be made from other materials and have other spring constants. Referring to FIGS. 1 and 2, an O-ring 54 is sandwiched between a cap or cover 52 and the body 12 forming a fluid seal. An annular recess 55, shown in FIG. 1, is defined in the value body 12 adjacent the cover 52. When machining the top thread of the body, this annular recess 55 aids in keeping any large chips/flaws forming at the bottom of the tapping.

Figure 8:
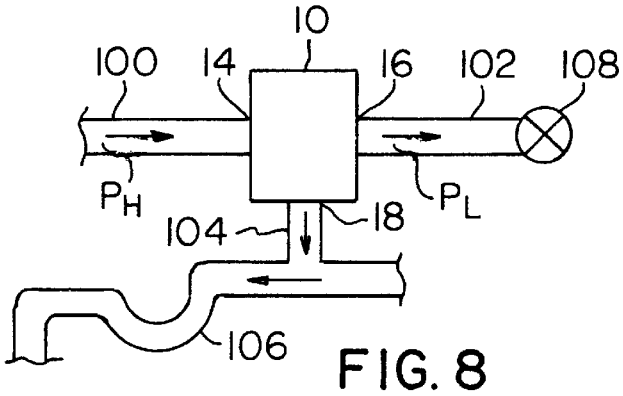
FIG. 8 is a schematic view of a trap primer installed in a typical plumbing system.

Referring to FIG. 8, the trap primer 10 is placed in a fluid circuit where an upstream side or high pressure side 100 is in fluid communication with the inlet port 14 and a downstream side 102 is in fluid communication with the outlet port 16. A trap line 104 is in fluid communication with the trap primer port 18. The trap line 104 is in fluid communication with a trap 106. Typically, an opened/closed plumbing device or valve 108, such as a faucet, is in fluid communication with the downstream side 102, downstream of the outlet port 16.

In operation, when the faucet or other plumbing device 108 is in a closed position, the pressure $P_H$ in the upstream side equals the pressure $P_L$ in the downstream side. The spring 50, which is in a compressed state, applies a downward force F (shown in FIG. 1) against the base 42 of the cylindrical open top portion 44, biasing the piston 36 in a closed position or first position and causing a flat lower surface or piston sealing surface 35 of the gasket seal 34 to be pressed against the frusta-spherical surface or seat sealing surface 25 of the trap primer seat 22 and form a fluid seal over the inlet hole 26 thereby blocking the inlet hole 26 of the passageway so that no water flows therethrough or through the body 12. The frusta-spherical surface 25 and the flat lower surface of the gasket seal 34, provides an improved fluid seal for low spring forces over an arrangement where both the surface 25 and the lower surface of the gasket seal are flat. When the faucet or other plumbing device 108 is opened, there is a pressure differential $P_H-P_L$ across the piston 36, wherein the inlet side has a higher pressure than the outlet side of the piston port. An upward force is applied to the piston which is approximately $\pi x$ (the radius of the base 42)$^2 \times (P_H - P_L)$. The spring is designed so that the initial upward force is greater than the downward force F of the spring 50. The initial upward force is dependent on $P_H$ and the flow rate through the plumbing system. A resulting force F', which is the difference between the upward force and the downward force, pushes the piston 36 upwardly and overcomes the downward force F caused by the spring 50. The piston sealing surface 35 is spaced a distance D away from the seat sealing surface. Therefore, the piston 36 is forced upwardly toward the cap 52 to an open position or second position, thereby permitting water or other fluid to flow from the inlet port 14 to the outlet port 16. Hence, the piston 36 is movable in the longitudinal direction X within the shut off cavity 20. Further, the gasket seal 34 moves away from the trap primer seat 22 permitting water to flow from the shut off cavity toward the inlet holes and the outlet holes of the trap primer seat 22. The amount of water that flows into the trap primer seat 22 is determined by the diameter of the inlet hole 26 and the outlet hole 28. Flow rates can be changed by adjusting the diameter of the holes 26 and 28 or passageway 24'.

When the faucet or other flow control device 108 is closed, the piston 36 again moves downwardly due to at least one of the dynamics of the fluid, the weight of the piston, and the spring force causing the lower surface of the gasket seal 34 to be pressed against the trap primer seat 22 and form a fluid seal over the inlet hole 26 preventing water from flowing therethrough.

Figure 7A:
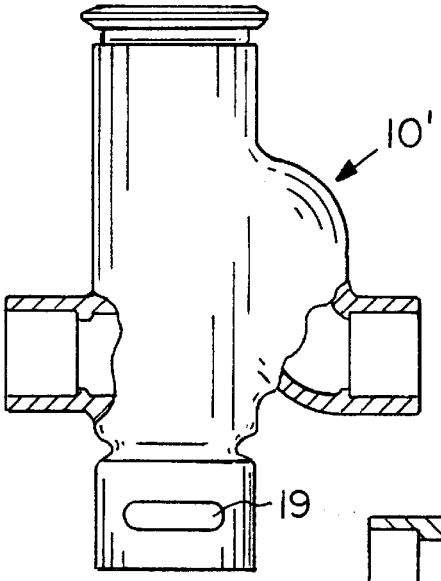
FIGS. 7*a*–7*c* are side elevational views of trap primer bodies.
Figure 7B:
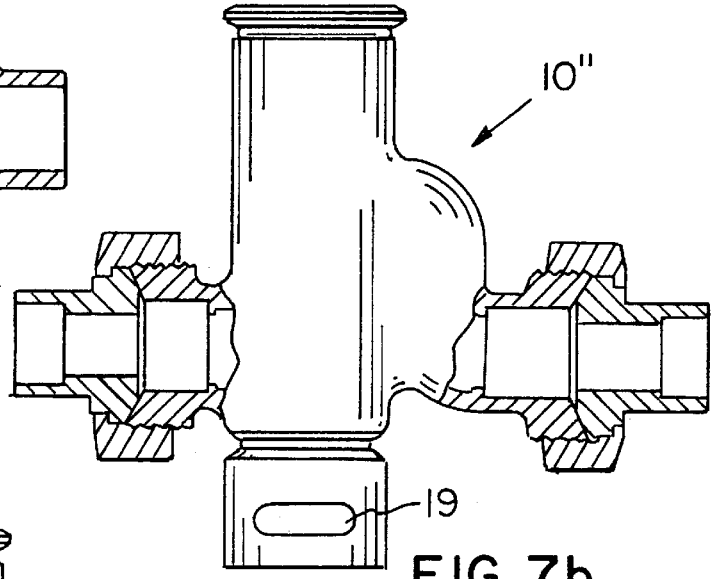
Figure 7C:
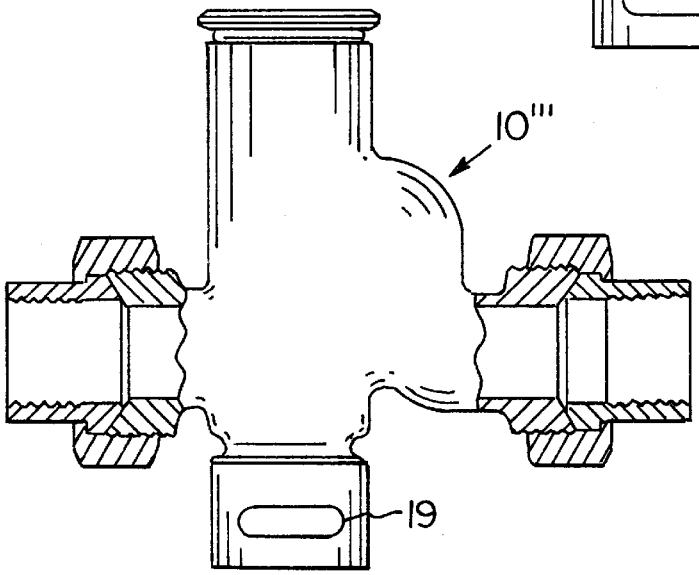

The spaced fingers 40, spaces 47 and spaced passageways 49 of the piston 36 permit the piston 36 to easily and quickly, almost instantaneously, move in an open and closed position. Prior art arrangements without such fingers 40, spaces 47 and passageways 49, cause a time delay in moving the piston 36 from the closed position to the open position due to a slug of water W contained is the space S above the piston 36 and the inability for the slug to flow easily toward the outlet port 16, as shown by the arrow in FIG. 1. Also, the prior art arrangements cause a time delay in moving the piston 36 from the open position to the closed position due to a vacuum formed in space S so that water cannot flow into space S; thereby, the piston was held in an open position. When the piston cannot move to the closed position, the water will continuously flow through the seat 22 to the trap 106, irrespective of whether the faucet 108 is open or closed, which defeats the purpose of a trap primer 10. The fingers 40, spaces 47 and passageways 49 are always in fluid communication with the space S and the outlet port 16, and a vacuum cannot be formed when the piston is in an open position and there is sufficient room to permit the slug of water to flow from space S when the piston 36 is moving to the open position. Another advantage of the present invention is that the trap primer seat 22 is removable. Therefore, the flow rate through the trap primer seat 22 can be changed easily by threadably removing one trap primer seat 22 and replacing it with a trap primer seat with a different flow rate, i.e., different diameters $d_1$ and $d_3$, or if the trap primer seat 22 becomes clogged or broken. Preferably, the installer uses a socket or adapter to coact with the nut N to install and remove the trap primer seat 22. A kit can be provided whereby the installer can change the trap primer seats to accommodate different flow rates to the trap, which are controlled by the diameters of the inlet hole 26 and the outlet hole 28. Likewise, the gasket seal 34 is removable from the piston tip 38 so that a replacement gasket seal 34 may be attached. FIGS. 7*a*, 7*b* and 7*c* show trap primers 10', 10" and 10''' similar to trap 10 except for the connections used defining the inlet port 14 and the outlet port 16.

Having described the currently preferred embodiments of the present invention, it is to be understood that the invention may be otherwise embodied within the scope of the appended claims.

We claim:

1. A trap primer, comprising:

a body defining an inlet port, an outlet port and a trap primer port in fluid communication with a shut off cavity; and a piston assembly received within the shut off cavity, said piston assembly including a piston movable in a longitudinal direction within the shut off cavity, said piston comprising a piston body having an outer surface, said outer surface has a plurality of circumferentially-spaced fingers extending along the longitudinal direction, said fingers defining finger passageways therebetween that extend along the longitudinal direction and said piston includes a piston sealing surface, and a seat defining a passageway in fluid communication with the trap primer port, said seat includes a seat sealing surface, wherein said piston is biased in a first position to block the passageway of said seat when liquid is not flowing through the body, and said piston is adapted to move to a second position when fluid is flowing from the inlet port to the outlet port through the body, permitting fluid to flow through the passageway of said seat whereby when said piston is in the first position, said piston sealing surface contacts said seat sealing surface and blocks said passageway and when said piston is in the second position said piston sealing surface is spaced a distance away from said seat sealing surface.

2. A trap primer as claimed in claim 1, wherein one of said seat sealing surface and said piston sealing surface is curved relative to the other of said seat sealing surface and piston sealing surface.

3. A trap primer as claimed in claim 2, wherein said seat sealing surface is curved relative to said piston sealing surface.

4. A trap primer as claimed in claim 3, wherein said seat sealing surface is frusta-spherical in shape.

5. A trap primer as claimed in claim 1, wherein said seat comprises a seat body secured to said body.

6. A trap primer as claimed in claim 5, wherein said seat body is threadably secured to said body.

7. A trap primer as claimed in claim 6, wherein said seat body comprises a cylindrically-shaped body defining a hollow cavity, an inlet hole, and an outlet hole, wherein the inlet hole, the hollow cavity, and the outlet hole are in fluid communication with each other, and the inlet hole is in direct fluid communication with the shut off cavity and the outlet hole is in direct fluid communication with said trap primer port, and wherein the passageway is defined by the inlet hole, the hollow cavity, and the outlet hole.

8. A trap primer as claimed in claim 7, wherein the inlet hole has an inlet diameter, the outlet hole has an outlet diameter, and the hollow cavity has a hollow cavity diameter, the hollow cavity diameter is greater than the inlet hole diameter and the outlet hole diameter.

9. A trap primer as claimed in claim 7, wherein said seat sealing surface defines said inlet hole.

10. A trap primer as claimed in claim 1, wherein said piston comprises a piston body having a cylindrical portion with a tip extending therefrom, said tip defining said piston sealing surface.

11. A trap primer as claimed in claim 10, wherein said tip comprises a gasket seal that includes said piston sealing surface.

12. A trap primer as claimed in claim 11, wherein said gasket seal comprises rubber.

13. A trap primer as claimed in claim 1, wherein said piston body includes an open top portion that defines an internal cavity having an upper edge offset from upper portions of said fingers, wherein spaces are defined between said fingers that are in fluid communication with the internal cavity and the finger passageway.

14. A trap primer as claimed in claim 13, further comprising a biasing member received within said internal cavity and sandwiched between said body and said piston.

15. A trap primer as claimed in claim 14, wherein said biasing member is a spring.

16. A trap primer as claimed in claim 5, wherein said seat body is solid with the exception of the passageway defined therein.

17. A trap primer as claimed in claim 16, wherein said seat body is removably secured to said body.

18. A trap primer as claimed in claim 17, wherein said seat body is threadably secured to said body.

19. A trap primer, comprising:

a body defining an inlet port, an outlet port and a trap primer port in fluid communication with a shut off cavity;

a piston assembly received within the shut off cavity, said piston assembly including a piston movable in a longitudinal direction within the shut off cavity and a spring; and a seat having a seat body defining a passageway in fluid communication with the trap primer port, said passageway defining an inlet hole and an outlet hole, wherein said piston is biased in a first position to block the passageway of said seat when liquid is not flowing through the body, and said piston is adapted to move to a second position when fluid is flowing from the inlet port to the outlet port through the body, permitting fluid to flow through the passageway of said seat, said piston includes a piston sealing surface and said seat includes a seat sealing surface, said seat sealing surface is curved relative to said piston sealing surface, whereby when said piston is in the first position, said piston sealing surface contacts said seat sealing surface and blocks the inlet hole of the passageway and when said piston is in said second position said piston sealing surface is spaced a distance away from said seat sealing surface, and wherein said seat sealing surface is frustaspherical in shape, and wherein said piston comprises a piston body having a cylindrical portion having a tip extending therefrom, a cylindrical closed bottom sleeve is received on said tip, said sleeve defining said piston sealing surface, said piston body having an outer surface, whereby said outer surface has a plurality of circumferentially-spaced fingers extending along the longitudinal direction, said fingers defining finger passageways therebetween that extend along the longitudinal direction, an open top portion that defines an internal cavity having an upper edge offset from upper portions of said fingers, whereby spaces are defined between said fingers that are in fluid communication with the internal cavity and the finger passageway, and wherein a spring is received within said internal cavity and sandwiched between said body and said piston.

20. A method for changing a trap primer seat comprising the steps of:

(a) providing a trap primer comprising:

a body defining an inlet port, an outlet port and a trap primer port in fluid communication with a shut off cavity;

a piston assembly received within the shut off cavity, said piston assembly including a piston movable in a longitudinal direction within the shut off cavity, said piston comprises a piston body having an outer surface, wherein said outer surface has a plurality of circumferentially-spaced fingers extending along the longitudinal direction, said fingers defining finger passageways therebetween that extend along the longitudinal direction and said piston includes a piston sealing surface, said piston includes a piston sealing surface; and a first trap primer seat having a seat body defining a passageway in fluid communication with the trap primer port, said passageway defining an inlet hole and an outlet hole, said seat includes a seat sealing surface, wherein said piston is biased in a first position to block the passageway of said first trap primer seat when liquid is not flowing through the body, and said piston is adapted to move to a second position when fluid is flowing from the inlet port to the outlet port through the body, permitting fluid to flow through the passageway of said first trap primer seat, said first trap primer seat includes a seat sealing surface, whereby when said piston is in the first position, said piston sealing surface contacts said seat sealing surface and blocks the inlet hole of the passageway and when said piston is in the second position said piston sealing surface is spaced a distance away from said seat sealing surface;

(b) removing said first trap primer seat; and (c) replacing said first trap primer seat with a second trap primer seat.

21. A method for changing a trap primer seat as claimed in claim 20, wherein at least one diameter of the inlet hole and the outlet hole of the second trap primer seat is different than the diameters of the inlet hole and the outlet hole of the first trap primer seat.

* * * * *